US010381151B2

(12) United States Patent
Shiota

(10) Patent No.: US 10,381,151 B2
(45) Date of Patent: Aug. 13, 2019

(54) TRANSFORMER USING COUPLING COIL

(71) Applicant: Toshiba Industrial Products and Systems Corporation, Kawasaki-shi, Kanagawa (JP)

(72) Inventor: Hiromu Shiota, Mie (JP)

(73) Assignee: TOSHIBA INDUSTRIAL PRODUCTS AND SYSTEMS CORP., Kanagawa (JP)

( * ) Notice: Subject to any disclaimer, the term of this patent is extended or adjusted under 35 U.S.C. 154(b) by 445 days.

(21) Appl. No.: 15/084,155

(22) Filed: Mar. 29, 2016

(65) Prior Publication Data

US 2016/0211070 A1 Jul. 21, 2016

Related U.S. Application Data

(63) Continuation of application No. PCT/JP2014/068300, filed on Jul. 9, 2014.

(30) Foreign Application Priority Data

Sep. 30, 2013 (JP) ..... 2013-204087

(51) Int. Cl.
*H01F 27/28* (2006.01)
*H01F 30/14* (2006.01)
*H01F 41/06* (2016.01)

(52) U.S. Cl.
CPC ..... *H01F 27/2823* (2013.01); *H01F 27/2866* (2013.01); *H01F 30/14* (2013.01)

(58) Field of Classification Search
CPC ..... H01F 27/2847; H01F 2027/2857; H01F 27/2866; H01F 41/061; H01F 27/2823
See application file for complete search history.

(56) References Cited

U.S. PATENT DOCUMENTS 217,466 A * 7/1879 Conte ..... H01F 21/005 336/15
3,195,088 A * 7/1965 Sandoz ..... H01F 27/2847 336/180

(Continued)

FOREIGN PATENT DOCUMENTS

CN 1581377 2/2005
CN 201402720 2/2010

(Continued)

OTHER PUBLICATIONS

CN201402720Y, Feb. 2010, Machine Translation.*

(Continued)

*Primary Examiner* — Elvin G Enad
*Assistant Examiner* — Malcolm Barnes
(74) *Attorney, Agent, or Firm* — DLA Piper LLP US

(57) ABSTRACT

The coupling coil structure, which is provided with a plurality of primary coils formed by winding a conductor wire and a plurality of secondary coils provided so as to generate mutual inductance with the plurality of primary coils and in which, among the plurality of primary coils, one primary coil is tapped at an intermediate portion thereof by another primary coil at right angles, is characterized in that, among the plurality of secondary coils, a secondary coil in mutual inductance with the one primary coil is constituted into a coupling coil by one conductor having a width at least the size in the axial direction of the primary coil.

1 Claim, 9 Drawing Sheets

(56) References Cited

U.S. PATENT DOCUMENTS

| | | | | | |
|---|---|---|---|---|---|
| 3,796,556 | A * | 3/1974 | Shepherd | C03B 23/245 65/156 |
| 4,282,393 | A * | 8/1981 | Williamson | H05B 3/0023 373/41 |
| 4,561,707 | A * | 12/1985 | Jackson | F02P 3/02 315/209 CD |
| 4,945,322 | A * | 7/1990 | Okumura | H01F 27/29 333/181 |
| 4,983,934 | A * | 1/1991 | Okumura | H01F 17/04 333/181 |
| 5,252,941 | A * | 10/1993 | Pitzele | H01F 27/2852 29/605 |
| 5,705,971 | A * | 1/1998 | Skibinski | H01F 27/2847 336/195 |
| 2005/0052271 | A1* | 3/2005 | Nakatsu | H01F 27/2847 336/206 |
| 2006/0227482 | A1* | 10/2006 | Ohta | H01F 27/2847 361/111 |
| 2008/0191815 | A1* | 8/2008 | Yanagisawa | H01F 17/043 333/204 |

FOREIGN PATENT DOCUMENTS

| | | | | |
|---|---|---|---|---|
| CN | 201402720 Y * | 2/2010 | | H01F 27/28 |
| JP | 56-36117 | 4/1981 | | |
| JP | 57112003 A * | 7/1982 | | H01F 27/289 |
| JP | 57112004 A * | 7/1982 | | H01F 27/289 |
| JP | S57-112003 | 12/1982 | | |
| JP | S57-112004 | 12/1982 | | |
| JP | H04-103116 | 4/1992 | | |
| JP | 2010-245183 | 10/2010 | | |

OTHER PUBLICATIONS

Chinese Office Action (with English Translation) issued in CN 201480053923.1 dated Dec. 27, 2016.
English Abstract of CN 1581377 dated Feb. 16, 2005.
English Abstract of CN 201402720 dated Feb. 10, 2010.
English Abstract of JP H04-103116 dated Apr. 6, 1992.
International Search Report dated Oct. 28, 2014 in International Application No. PCT/JP2014/068300.
English Translation of International Search Report dated Oct. 28, 2014 in International Application No. PCT/JP2014/068300.
Written Opinion dated Oct. 28, 2014 in International Application No. PCT/JP2014/068300.
English Translation of Written Opinion dated Oct. 28, 2014 in International Application No. PCT/JP2014/068300.
English Translation of International Preliminary Report on Patentability dated Apr. 5, 2016 in International Application No. PCT/JP2014/068300.
English Translation of JP 56-36117(A1), also JP 58-37972(62) dated Apr. 9, 1981.
English Abstract of JP 2010-245183 dated Oct. 28, 2010.
Indian Office Action dated Jan. 31, 2019 in Application No. 201647014425.

* cited by examiner

TRANSFORMER USING COUPLING COIL

CROSS REFERENCE TO RELATED APPLICATIONS

This application is a Continuation of International Application No. PCT/JP2014/068300 filed Jul. 9, 2014, which claims priority from Japanese Patent Application No. 2013-204087 filed Sep. 30, 2013. The entirety of all of the above-listed Applications are incorporated herein by reference.

TECHNICAL FIELD

An embodiment of the present invention relates to a coupling coil structure and a transformer.

BACKGROUND ART

Conventionally, in a Scott-connected transformer or the like, for example, a coupling coil has been employed for the following reason: That is, a Scott-connected transformer 10 shown, for example, in FIG. 5 includes an iron core 11, a main-phase primary coil 12, a teaser primary coil 13, a main-phase secondary coil 14, and a teaser secondary coil 15. Each of the coils 12, 13, 14, and 15 is configured such that a conductor wire is wound around the iron core 11. One end of the teaser primary coil 13 intersects and is connected to the main-phase primary coil 12 at a middle point N thereof, which is a midway portion thereof. A three-phase power supply that is not shown is connected to a terminal V of the teaser primary coil 13 and terminals U and W of the main-phase primary coil 12.

A first single-phase load 91 is connected to terminals 1*u* and 1*v* of the main-phase secondary coil 14, which is one of the secondary coils 14 and 15. A second single-phase load 92 is connected to terminals 2*u* and 2*v* of the teaser secondary coil 15. The voltage outputted from the main-phase secondary coil 14 and the voltage outputted from the teaser secondary coil 15 are shifted from each other by a phase difference of 90°. In this case, mutual induction occurs between the main-phase primary coil 12 and the main-phase secondary coil 14 and between the teaser primary coil 13 and the teaser secondary coil 15.

FIG. 6 shows current flowing through the Scott-connected transformer 10 in FIG. 5 in a state in which only the first single-phase load 91 is connected to the terminals 1*u* and 1*v* of the main-phase secondary coil 14 but the second single-phase load 92 is not connected to the terminals 2*u* and 2*v* of the teaser secondary coil 15. Current i1*m* flowing through the main-phase primary coil 12 and current i2*m* flowing through the main-phase secondary coil 14 flow in such a way that the ampere-turns of the two coils 12 and 14 cancel each other out. In this case, the short-circuit impedance in the main-phase primary coil 12 and the main-phase secondary coil 14 is the leakage impedance between the two coils 12 and 14.

In contrast, FIG. 7 shows current flowing through the Scott-connected transformer 10 in FIG. 5 in a state in which only the second single-phase load 92 is connected to the terminals 2*u* and 2*v* of the teaser secondary coil 15 but the first single-phase load 91 is not connected to the terminals 1*u* and 1*v* of the main-phase secondary coil 14. Current i1*t* flowing through the teaser primary coil 13 flows so as to cancel the ampere-turns of current i2*t* flowing through the teaser secondary coil 15 and then splits at the middle point N into current i1*t*1 and current i1*t*2, which flow through the main-phase primary coil 12.

In this case, the short-circuit impedance on the teaser side is the sum of the leakage impedance between the teaser primary coil 13 and the teaser secondary coil 15 and the leakage impedance between a U-side main-phase primary coil 121 and a W-side main-phase primary coil 122. Therefore, to reduce the short-circuit impedance on the teaser side, it is necessary to reduce the leakage impedance between the U-side main-phase primary coil 121 and the W-side main-phase primary coil 122.

In the configuration described above, employing the structure of a coupling coil as the structure of the main-phase secondary coil 14, as shown in FIGS. 8 and 9, allows reduction in the leakage impedance between the U-side main-phase primary coil 121 and the W-side main-phase primary coil 122. A coupling coil refers to a structure having a function of improving magnetic coupling between a plurality of windings set apart from each other.

The structure of the coupling coil is configured, for example, as follows: That is, the main-phase secondary coil 14 is divided at a middle portion into two coils, a U-side main-phase secondary coil 141 and a W-side main-phase secondary coil 142. The U-side main-phase secondary coil 141 and the W-side main-phase secondary coil 142 are connected in parallel to each other. The U-side main-phase secondary coil 141 faces the U-side main-phase primary coil 121, and the W-side main-phase secondary coil 142 faces the W-side main-phase primary coil 122.

In this configuration, the second single-phase load 92 is connected to the terminals 2*u* and 2*v* of the teaser secondary coil 15, and the current i1*t* having flowed through the teaser primary coil 13 splits into current flowing through the U-side main-phase primary coil 121 and current flowing through the W-side main-phase primary coil 122, as shown in FIG. 8. As a result, mutual induction between the main-phase primary coil 12 and the main-phase secondary coil 14 induces electromotive force in the main-phase secondary coil 14. Current i2*t*1 therefore flows through the U-side main-phase secondary coil 141 so as to cancel the ampere-turns of the current lit' flowing through the U-side main-phase primary coil 121. Similarly, current i2*t*2 flows through the W-side main-phase secondary coil 142 so as to cancel the ampere-turns of the current i1*t*2 flowing through the W-side main-phase primary coil 122.

The current i2*t*1 and the current i2*t*2 circulate through the path formed of the U-side main-phase secondary coil 141 and the W-side main-phase secondary coil 142. The circulating current i2*t*1 and current i2*t*2 cancel the ampere-turns of the current flowing through the U-side main-phase primary coil 121 and the current flowing through the W-side main-phase primary coil 122, into which the current i1*t* flowing through the teaser primary coil 13 splits. As a result, the magnetic coupling between the U-side main-phase primary coil 121 and the W-side main-phase primary coil 122 is improved, whereby the leakage impedance between the U-side main-phase primary coil 121 and the W-side main-phase primary coil 122 can be reduced.

CITATION LIST

Patent Literature

Patent Literature 1: Japanese Patent Laid-Open No. 8-335520

SUMMARY OF INVENTION

Technical Problem

In the structure of the coupling coil of related art shown in FIGS. 8 and 9, however, the following problem exists: First, the main-phase secondary coil 14, which is originally formed of a single coil, needs to be divided into a plurality of coils, for example, the two coils 141 and 142, which then need to be connected in parallel to each other, resulting in increases in time and effort for formation of the two coils 141 and 142 and hence a decrease in productivity. Second, since the main-phase secondary coil 14 is formed of the divided U-side main-phase secondary coil 141 and W-side main-phase secondary coil 142, the number of turns of conductor wires increases as compared with the case where the main-phase secondary coil 14 is formed of a single coil. The space factor of the main-phase secondary coil 14 with respect to the overall cross-sectional area of the transformer therefore decreases so that the size of the main-phase secondary coil 14 increases, resulting in an increase in the overall size and weight of the transformer.

An object of the present invention is to provide a coupling coil structure that allows improvement in productivity and reduction in size and weight and a transformer using the coupling coil structure.

Solution to Problem

A coupling coil structure according to an embodiment of the present invention includes a plurality of primary coils formed by winding a conductor wire and a plurality of secondary coils provided such that mutual induction occurs between the plurality of primary coils and the plurality of secondary coils. One of the plurality of primary coils intersects and is connected to another primary coil at a midway portion of the one primary coil, and one of the plurality of secondary coils that allows mutual induction to occur between the one primary coil and the one secondary coil forms a coupling coil formed of a single conductor having a width greater than or equal to an axial dimension of the one primary coil.

A transformer according to the present embodiment includes the secondary coil that forms the coupling coil described above.

DESCRIPTION OF EMBODIMENTS

An embodiment will be described below with reference to the drawings.

Figure 1:
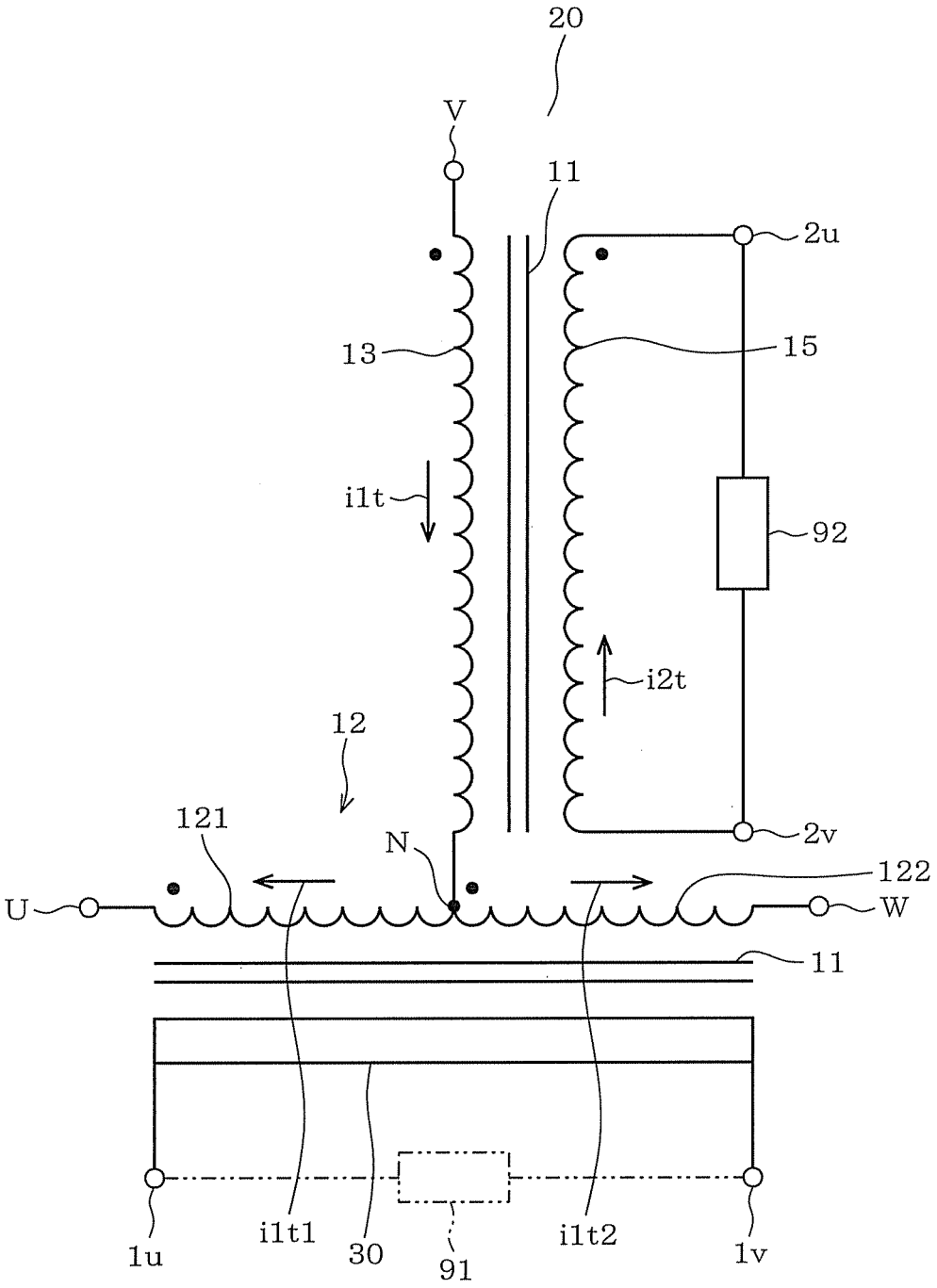
FIG. 1 shows the configuration of a Scott-connected transformer using a coupling coil structure according to an embodiment.
Figure 5:
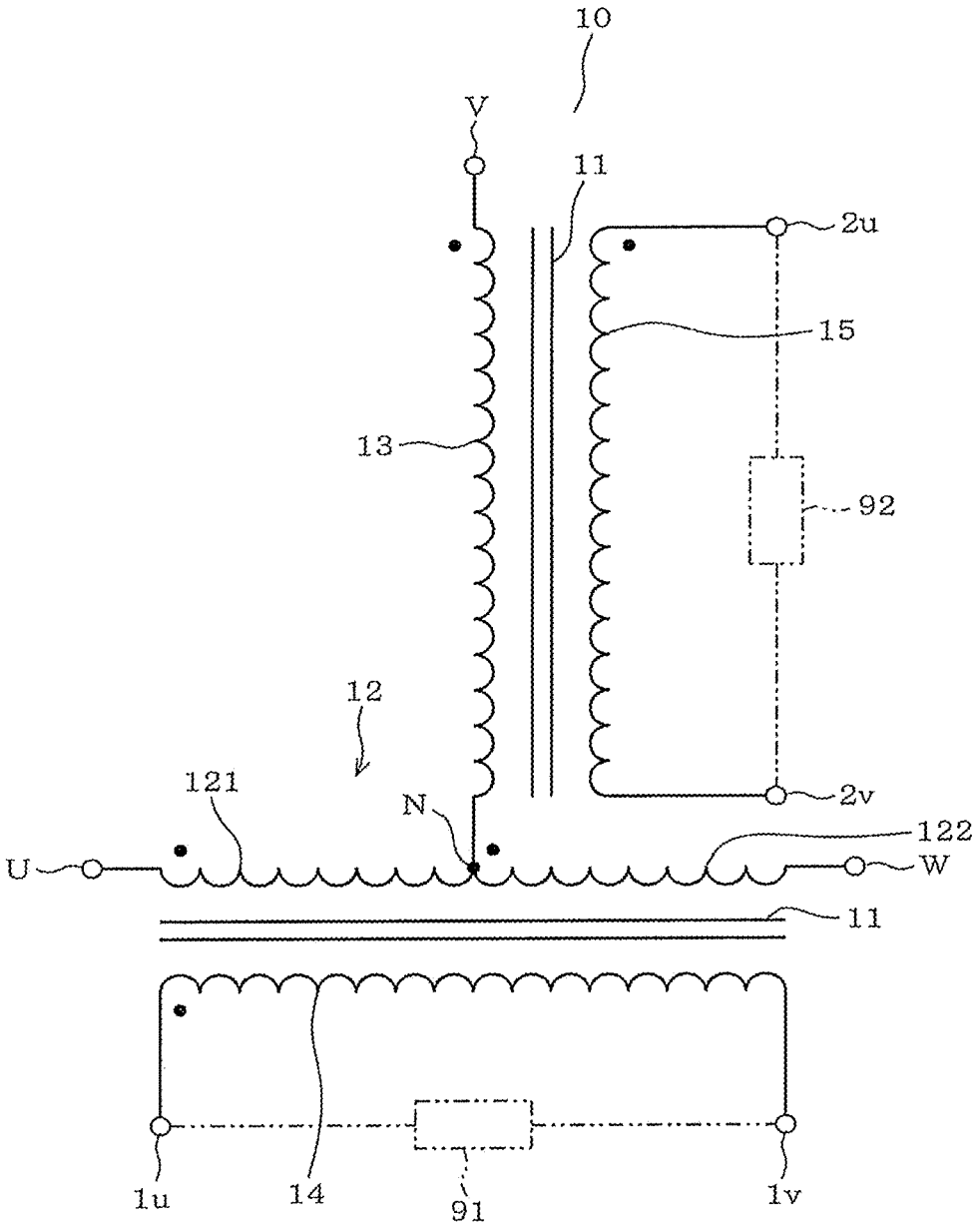
FIG. 5 Related Art
FIG. 5 shows the configuration of a Scott-connected transformer of related art.
Figure 6:
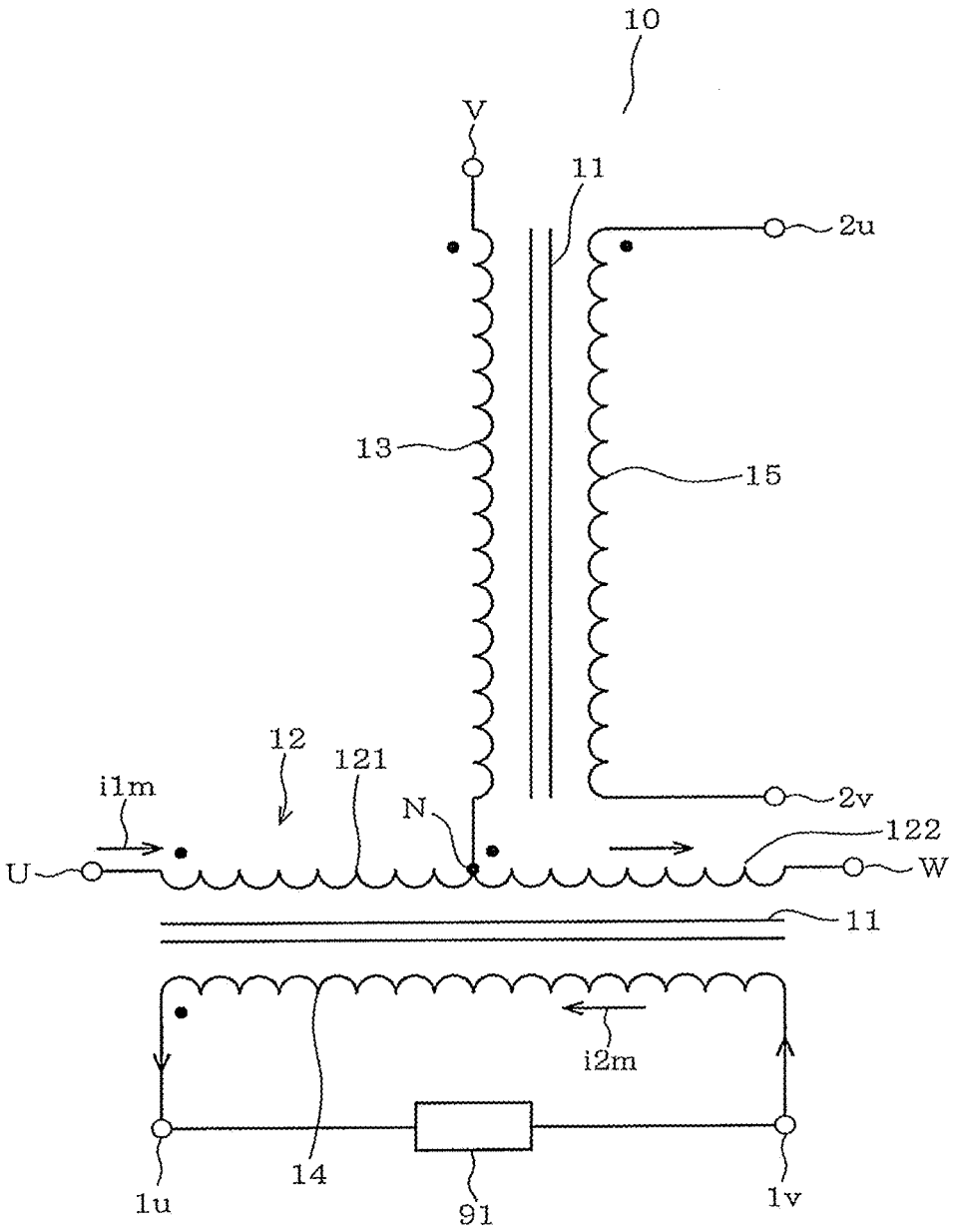
FIG. 6 Related Art
FIG. 6 shows a state in which a first single-phase load is connected to a main-phase secondary coil of the Scott-connected transformer in FIG. 5.
Figure 7:
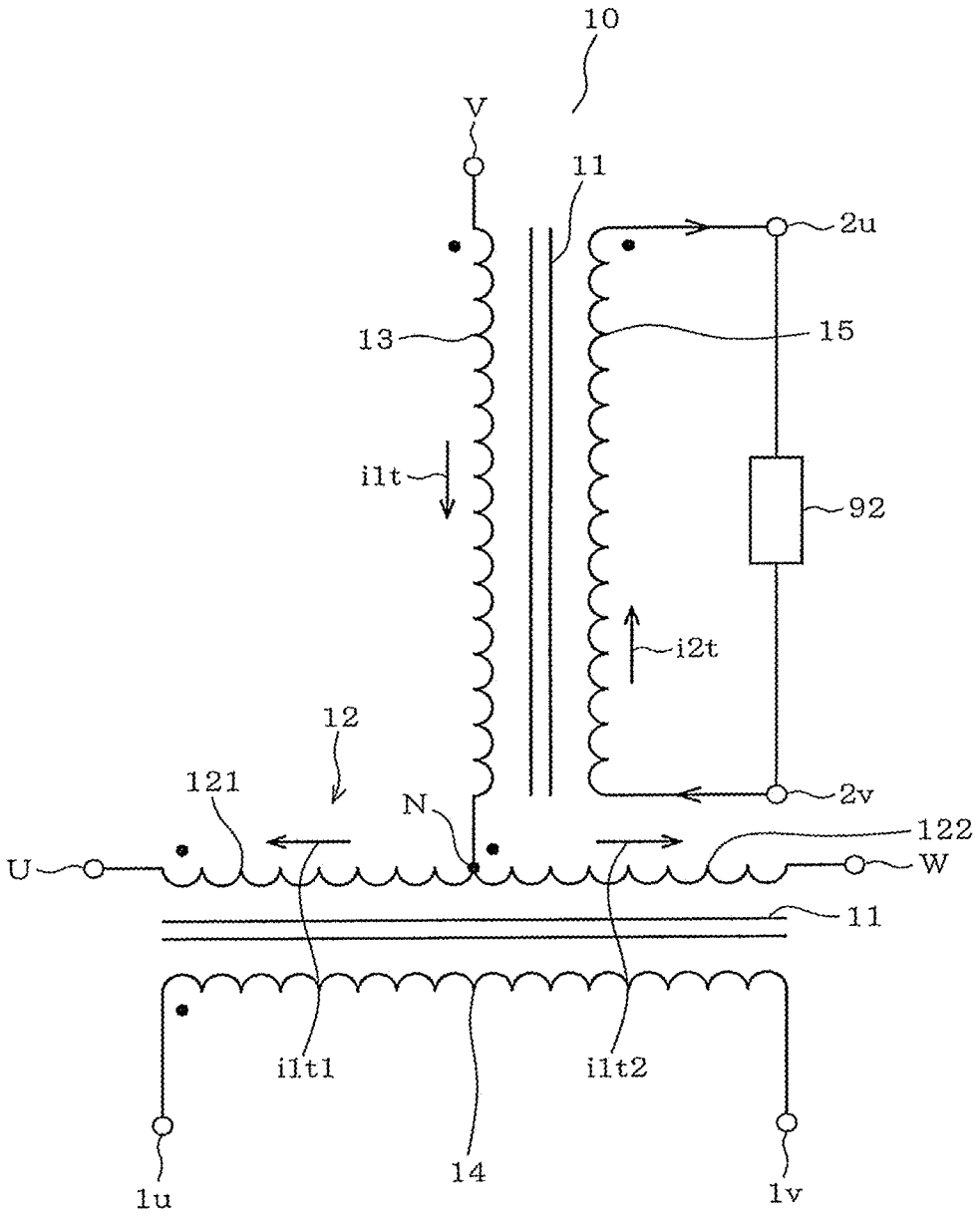
FIG. 7 Related Art
FIG. 7 shows a state in which a second single-phase load is connected to a teaser secondary coil of the Scott-connected transformer in FIG. 5.
Figure 8:
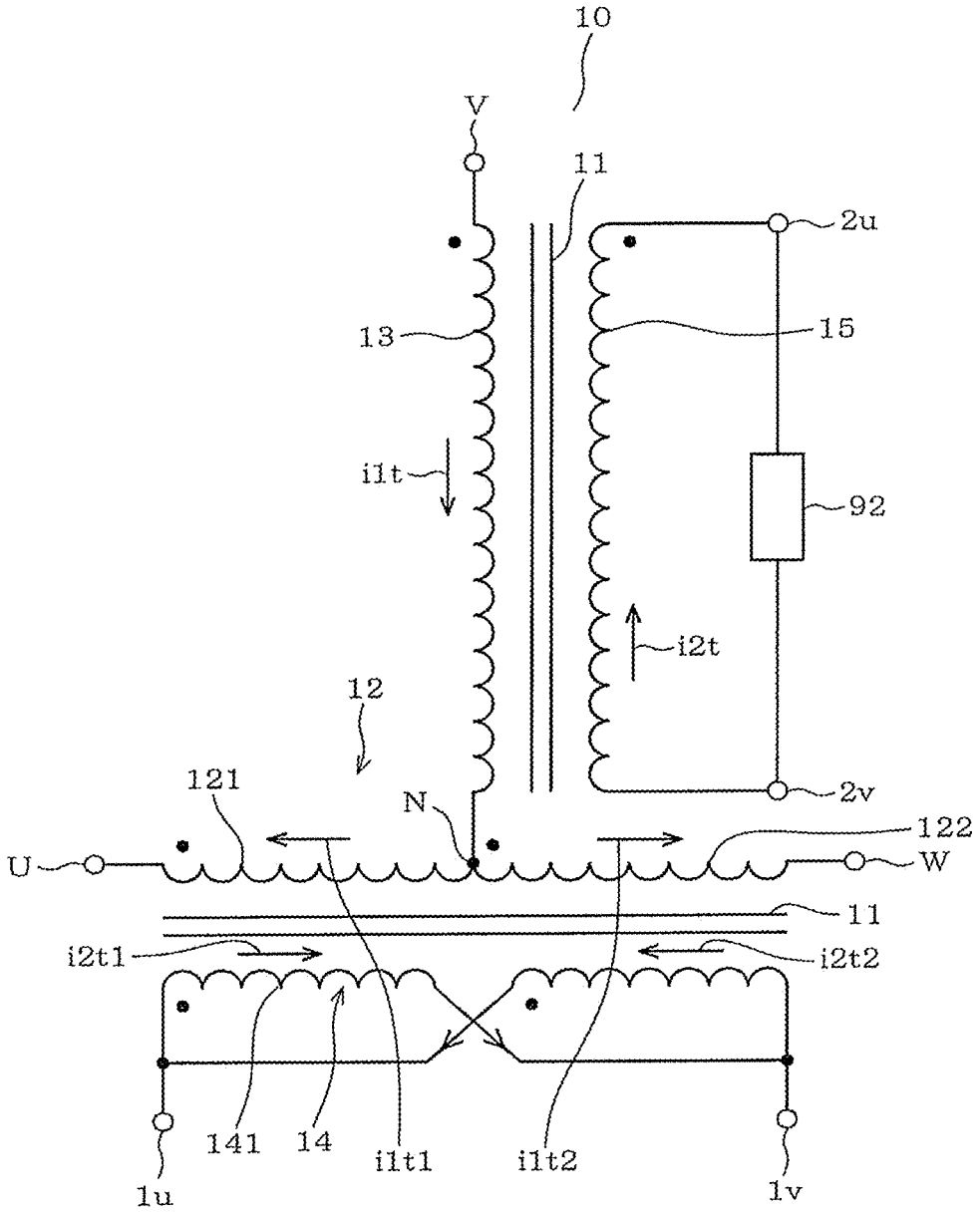
FIG. 8 Related Art
FIG. 8 shows that a coupling coil structure of related art is employed in the Scott-connected transformer.
Figure 9:
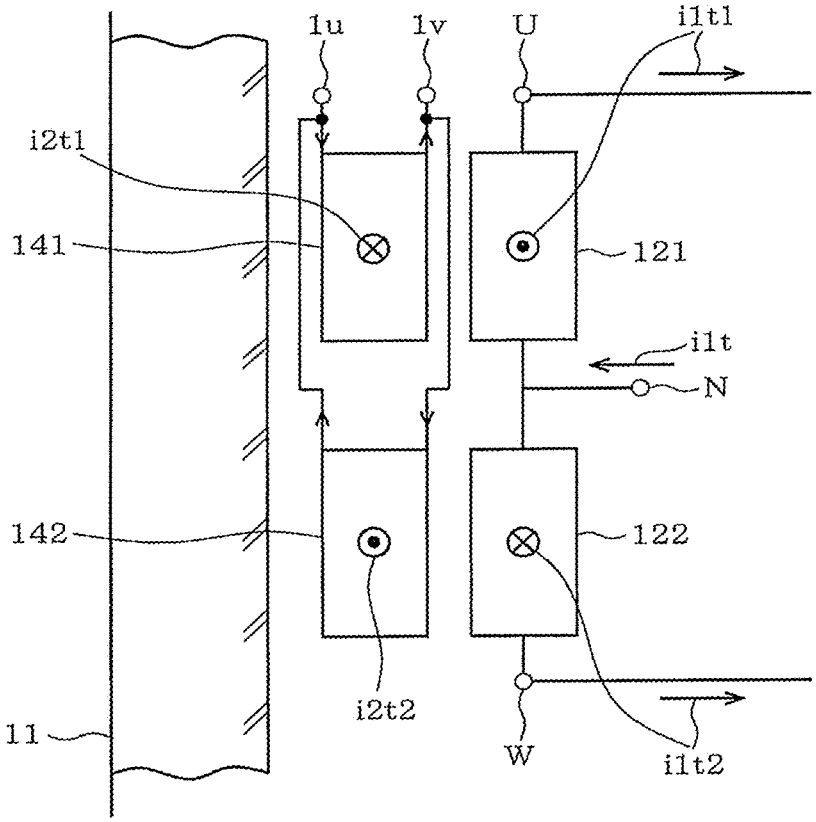
FIG. 9 Related Art
FIG. 9 shows the configuration of the main-phase primary coil and the main-phase secondary coil in FIG. 8 and therearound.

FIG. 1 shows the Scott-connected transformer 10 shown in FIG. 5 to which a coupling coil structure according to the present embodiment is applied. A Scott-connected transformer 20 shown in FIGS. 1 and 2 includes the iron core 11, the main-phase primary coil 12, the teaser primary coil 13, and the teaser secondary coil 15, as in the Scott-connected transformer 10 shown in FIG. 5. The Scott-connected transformer 20 shown in FIGS. 1 and 2 further includes a main-phase secondary coil 30 which is a coupling coil in place of the main-phase secondary coil 14 shown in FIG. 5. The Scott-connected transformer 20 shown in FIGS. 1 and 2 is the same as the Scott-connected transformer 10 shown in FIG. 5 in terms of configuration except the main-phase secondary coil 30.

That is, the teaser primary coil 13 and the teaser secondary coil 15 are each formed by winding a conductor wire around the iron core 11 and are configured concentrically with each other. The Scott-connected transformer 20 is configured such that the main-phase primary coil 12, which is one of the plurality of primary coils 12 and 13, intersects the teaser primary coil 13, which is the other primary coil, in a T-like shape in such a way that the teaser primary coil 13 is connected to the main-phase primary coil 12 at a midway portion of the main-phase primary coil 12, that is, a middle point N between a U-side main-phase primary coil 121 and a W-side main-phase primary coil 122. Each of the U-side main-phase primary coil 121 and the W-side main-phase primary coil 122 is formed by winding a conductor wire around the iron core 11. The U-side main-phase primary coil 121 and the W-side main-phase primary coil 122 are arranged side by side along the axial direction of the coils.

Figure 3:
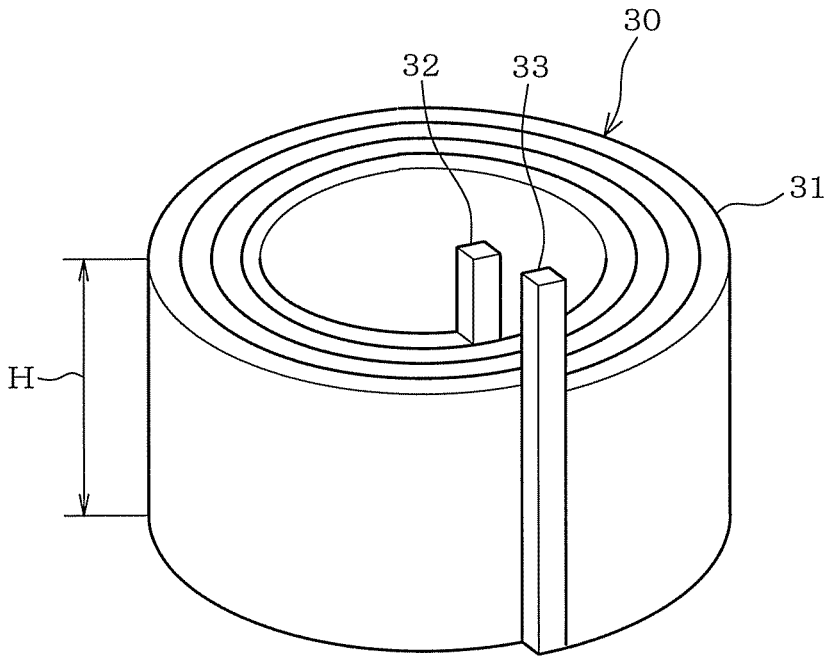
FIG. 3 is a perspective view showing the configuration of the main-phase secondary coil in FIG. 1.

The main-phase secondary coil 30 is provided so as to face the main-phase primary coil 12. Mutual induction occurs between the main-phase secondary coil 30 and the main-phase primary coil 12. The main-phase secondary coil 30 arranged concentrically with the main-phase primary coil 12, which is formed of the U-side main-phase primary coil 121 and the W-side main-phase primary coil 122. The main-phase secondary coil 30 is formed by winding a single sheet-shaped conductor having conductivity, for example, a single thin plate 31 made of a metal, such as aluminum or copper, around the iron core 11, as also shown in FIGS. 3 and 4.

Figure 2:
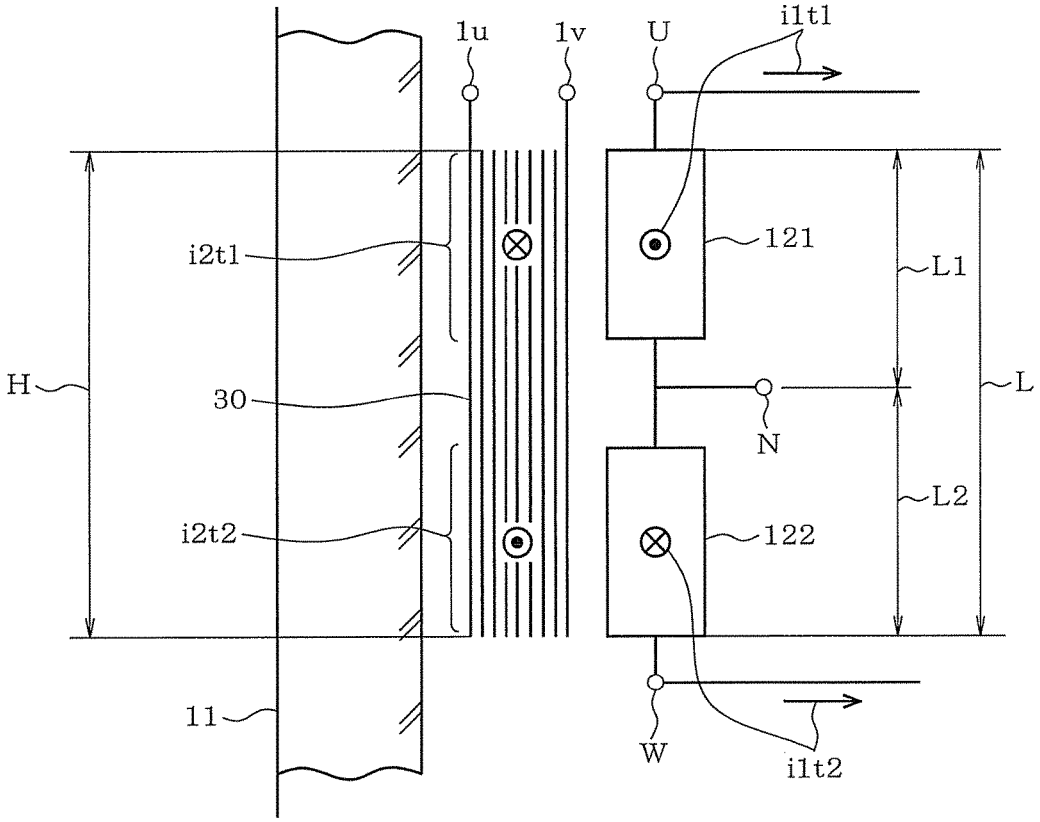
FIG. 2 shows the configuration of a main-phase primary coil and a main-phase secondary coil in FIG. 1 and therearound.

The axial dimension H of the main-phase secondary coil 30, that is, the width of the main-phase secondary coil 30 is set to be greater than or equal to the axial dimension L of the main-phase primary coil 12, that is, the sum of the axial dimension L1 of the U-side main-phase primary coil 121 and the axial dimension L2 of the W-side main-phase primary coil 122, as shown in FIG. 2. In the present embodiment, the width H of the main-phase secondary coil 30 is roughly equal to the axial dimension L of the main-phase primary coil 12. The main-phase secondary coil 30 has lead wires 32 and 33 located at the opposite ends thereof, as shown in FIGS. 3 and 4. Each of the lead wires 32 and 33 is, for example, a rod made of a metal, such as aluminum or copper. The lead wires 32 and 33 are welded or otherwise connected to the thin plate 31. End portions of the lead wires 32 and 33 function as the terminals 1*u* and 1*v*, to which the first single-phase load 91 is connected.

A description will next be made of current flowing through the Scott-connected transformer 20 in a state in which only the second single-phase load 92 is connected to the terminals 2*u* and 2*v* of the teaser secondary coil 15 but the first single-phase load 91 is not connected to the terminals 1*u* and 1*v* of the main-phase secondary coil 30, as shown in FIG. 1. In this case, the current lit having flowed through the teaser primary coil 13 splits into the current i1*t*1 flowing through the U-side main-phase primary coil 121 and the current i1*t*2 flowing through the W-side main-phase primary coil 122. As a result, the current i2*t*1, which flows so as to cancel the ampere-turns of the current i1*t*1 flowing through the U-side main-phase primary coil 121, flows through a portion of the main-phase secondary coil 30, that is, a portion thereof facing the U-side main-phase primary coil 121, as shown in FIG. 2. Similarly, the current i2*t*2, which flows so as to cancel the ampere-turns of the current i1*t*2 flowing through the W-side main-phase primary coil 122, flows through a portion of the main-phase secondary coil 30, that is, a portion thereof facing the W-side main-phase primary coil 122.

Figure 4:
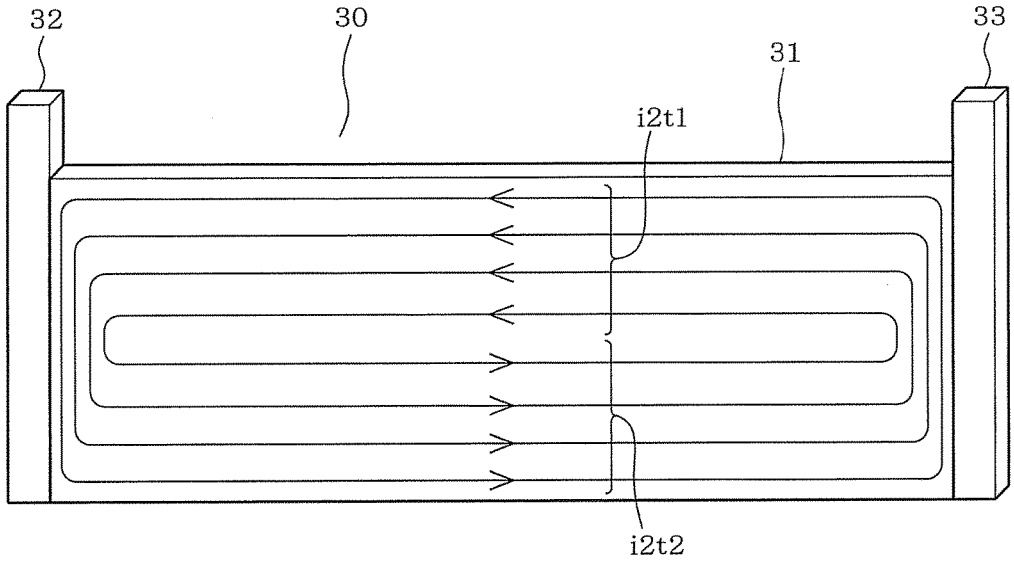
FIG. 4 is a development of the main-phase secondary coil in FIG. 3.

The current i2*t*1 and the current i2*t*2 flowing through the main-phase secondary coil 30 circulate in the main-phase secondary coil 30 to cancel the ampere-turns of the current i1*t*1 flowing through the U-side main-phase primary coil 121 and the current i1*t*2 flowing through the W-side main-phase primary coil 122, as shown in FIG. 4. Therefore, in the main-phase primary coil 12, the magnetic coupling between the U-side main-phase primary coil 121 and the W-side main-phase primary coil 122 can be improved, whereby the leakage impedance between the main-phase primary coils 121 and 122 can be reduced.

According to the configuration, the main-phase secondary coil 30 is formed by winding the single thin plate 31 around the iron core 11. The main-phase secondary coil 30 therefore does not need to be divided into a plurality of coils or connected in parallel to each other in order to form a coupling coil, unlike the main-phase secondary coils 141 and 142 having the configuration of related art. The coupling coil can therefore be configured with no increase in time or effort, whereby a decrease in productivity is avoided.

Further, since the main-phase secondary coil 30 is formed of a sheet-shaped thin plate 31, it is unnecessary to wind a large number of conductor wires. The main-phase secondary coil 30 according to the present embodiment can therefore provide a higher proportion of the conductor with respect to the cross section of the coil than in a case where a large number of conductor wires are wound. That is, according to the present embodiment, a decrease in the space factor of the conductor with respect to the overall cross-sectional area of the main-phase secondary coil 30 can be avoided even when the structure of a coupling coil is employed, whereby an increase in the size of the main-phase secondary coil 30 can be avoided.

Further, in the present embodiment, the width H of the main-phase secondary coil 30 is set to be roughly equal to the axial dimension L of the main-phase primary coil 12. Since the main-phase secondary coil 30 is thus allowed to face the entire main-phase primary coil 12, the current i2*t*1 and i2*t*2 circulating in the main-phase secondary coil 30 can cancel the ampere-turns of the current i1*t*1 flowing through the U-side main-phase primary coil 121 and the current i1*t*2 flowing through the W-side main-phase primary coil 122. As a result, the magnetic coupling between the U-side main-phase primary coil 121 and the W-side main-phase primary coil 122 can be further improved, whereby the leakage impedance between the main-phase primary coils 121 and 122 can be more efficiently reduced.

The main-phase secondary coil 30 has the lead wires 32 and 33 located at the opposite ends thereof, which serve as a winding start and a winding end of the thin plate 31, which serves as a conductor. The lead wires 32 and 33 allow the terminals 1*u* and 1*v* to be readily provided even when the thin plate 31 is used as the conductor of the main-phase secondary coil 30.

The main-phase secondary coil 30 may be configured such that a large number of conductor wires are woven in a cloth-like shape to form a single conductor as a whole.

The coupling coil structure according to the embodiment described above is not necessarily applied to a Scott-connected transformer and is generally applicable to a coupling winding structure for improving the magnetic coupling between a plurality of coils set apart from each other and a transformer using the coupling winding structure.

As described above, the coupling coil structure according to the embodiment includes a plurality of primary coils formed by winding a conductor wire and a plurality of secondary coils provided such that mutual induction occurs between the plurality of primary coils and the plurality of secondary coils, and one of the plurality of primary coils intersects and is connected to another primary coil at a midway portion of the one primary coil, and one of the plurality of secondary coils that allows mutual induction to occur between the one primary coil and the one secondary coil forms a coupling coil formed of a single conductor having a width greater than or equal to the axial dimension of the one primary coil.

As a result, the secondary coil corresponding to the one primary coil forms a coupling coil formed of the single conductor having a width greater than or equal to the axial dimension of the one primary coil. The secondary coil corresponding to the one primary coil therefore does not need to be divided into a plurality of coils or connected in parallel to each other in order to form a coupling coil. The coupling coil can therefore be configured with no increase in time or effort, whereby a decrease in productivity is avoided. Further, since the secondary coil configured as a coupling coil is formed of a single conductor, it is unnecessary to wind a large number of conductor wires to form the secondary coil, whereby the space factor of the conductor is reduced and an increase in the size of the secondary coil is therefore avoided.

An embodiment of the present invention has been described. The embodiment is presented by example and is not intended to limit the scope of the invention. The novel embodiment can be implemented in a variety of other forms, and a variety of types of omission, replacement, and change can be made to the embodiment to the extent that the changes do not depart from the substance of the invention. The embodiment and the changes fall within not only the scope and substance of the invention but also the invention set forth in the claims and equivalents thereto.

The invention claimed is:

1. A transformer comprising:

a main-phase primary coil formed by winding a conductor wire;

a teaser primary coil formed by winding a conductor wire and intersecting and connected to the main-phase primary coil at the midway portion of the main-phase primary coil;

a main-phase secondary coil provided such that mutual induction occurs between the main-phase primary coil and the main-phase secondary coil; and a teaser secondary coil formed by winding a conductor wire and provided such that mutual induction occurs between the teaser primary coil and the teaser secondary coil, wherein the main-phase primary coil is formed by winding a plurality of coils side by side along the axial direction of the coils, the main-phase secondary coil forms a coupling coil formed by winding a single thin plate made of a metal having a width greater than or equal to an axial dimension of the main-phase primary coil, and has lead wires at opposite ends of the thin plate made of a metal, the lead wires serving as a winding start and a winding end of the thin plate made of a metal, and each of the lead wires is a rod made of a metal and is welded and connected to the thin plate.

* * * * *